United States Patent [19]

Parlman et al.

[11] 4,295,962

[45] Oct. 20, 1981

[54] RECOVERING COPPER BY FLOTATION USING N-MERCAPTOALKYL AMIDE DEPRESSANT

[75] Inventors: Robert M. Parlman; Ralph P. Williams, both of Bartlesville, Okla.

[73] Assignee: Phillips Petroleum Company, Bartlesville, Okla.

[21] Appl. No.: 145,093

[22] Filed: Apr. 30, 1980

[51] Int. Cl.[3] ..... B03D 1/06

[52] U.S. Cl. ..... 209/167

[58] Field of Search ..... 209/166, 167

[56] References Cited

U.S. PATENT DOCUMENTS

| | | | |
|---|---|---|---|
| 2,449,984 | 9/1948 | Gibbs | 209/167 |
| 3,006,471 | 10/1961 | Luttinger | 209/167 X |
| 3,235,077 | 2/1966 | McGarry | 209/166 |
| 3,329,266 | 7/1967 | Cox | 209/167 |
| 3,788,467 | 1/1974 | Werneke | 209/167 |
| 4,196,073 | 4/1980 | Gannon | 209/167 |

*Primary Examiner*—Robert Halper

[57] ABSTRACT

A process for recovering copper-bearing mineral sulfides from a froth-floated, metallurgical concentrate by admixing the concentrate with a sufficient amount of N-mercaptoalkyl amide to depress the copper-bearing mineral sulfides during a flotation and recovering the non-floating copper-bearing mineral sulfides from the flotation process. In an embodiment, copper-bearing mineral sulfides are subjected to flotation process in the presence of a flotation agent with recovery of floated metallurgical concentrate containing copper-bearing mineral sulfides and thereafter refloating the metallurgical concentrate with admixing with N-mercaptoalkyl amide depressant to recover the non-floating copper-bearing mineral sulfides.

6 Claims, No Drawings

RECOVERING COPPER BY FLOTATION USING N-MERCAPTOALKYL AMIDE DEPRESSANT

BACKGROUND OF THE INVENTION

This invention relates to flotation processes for recovering minerals from their ores. In another aspect of the invention it relates to the recovery of copper-bearing mineral sulfides from their ores. In another aspect of the invention it relates to the use of flotation agents and flotation depressants in the recovery of minerals from their ores.

Froth flotation is a process for concentrating minerals from ores. In a froth flotation process, the ore is crushed and wet ground to obtain a pulp. Additives such as mineral flotation or collecting agents and frothing agents are added to the pulp to assist in subsequent flotation steps in separating valuable minerals from the undesired, or gangue, portions of the ore. The pulp is then aerated to produce a froth at the surface. The minerals which adhere to the bubbles or froth are skimmed or otherwise removed and the mineral-bearing froth is collected and further processed to obtain the desired minerals. Frequently, other chemicals are added to the separated mineral-bearing froth to assist in subsequent separations particularly when significant proportions of two or more minerals are present in the separated mineral-bearing froth. Such chemicals are known as depressant agents. These materials are sometimes referred to more appropriately as deactivators and are used selectively to separate one type of mineral from another type of mineral. In sulfide mineral flotation, a depressant action is achieved on copper sulfide by the use of sodium sulfide. U.S. Pat. No. 3,785,488 discloses the use of thio alcohols as depressant agents in a froth flotation process for recoverying molybdenite ($MoS_2$) from a metallurgical concentrate in which there is a major portion of copper sulfide and other sulfides and a minor portion of molybdenum sulfide. The essence of the instant invention is to provide an alternative family of copper depressants for ore flotation processes.

It is therefore an object of this invention to provide compounds suitable as depressants for copper-bearing mineral sulfides for use in ore flotation processes. It is another object of this invention to provide a method for recovering copper-bearing mineral sulfides from their ores using ore flotation processes. It is still another object of this invention to provide ore processes employing both flotation agents and flotation depressants.

Other aspects, objects and the various advantages of this invention will become apparent upon reading this specification and the appended claims.

STATEMENT OF THE INVENTION

According to this invention, a process is provided for recovering copper-bearing mineral sulfide from a metallurgical concentrate. In the process a metallurgical concentrate containing copper-bearing mineral sulfides is admixed in a froth flotation process with an amount of N-mercaptoalkyl amide sufficient to depress the flotation of the copper-bearing mineral sulfides and the non-floating copper-bearing mineral sulfides are recovered from the flotation slurry.

In a further embodiment of the invention the metallurgical concentrate containing copper-bearing mineral sulfides is obtained from the floated froth of a flotation process that employs a flotation agent to separate the copper-bearing mineral sulfides from the flotation slurry with subsequent recovery and concentration of the flotation slurry.

N-mercaptoalkyl amides useful in this invention are those materials represented by either formulas I, II, or III

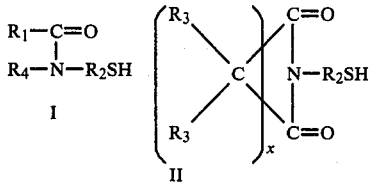

I

II

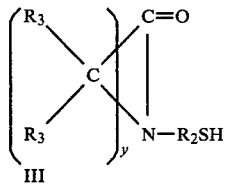

III wherein $R_1$ and $R_3$ are selected from the group consisting of hydrogen, alkyl and cycloalkyl radicals, and combinations of said radicals such as alkylcycloalkyl, cycloalkylalkyl, alkylcycloalkylalkyl, polycycloalkyl and alkylpolycycloalkyl; $R_2$ is an alkylene radical; and $R_4$ is selected from the group consisting of $R_1$ and the radical

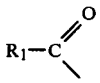

$R_1$ can have 1 to 20, preferably 1 to 6, carbon atoms, $R_2$ can have 2 to 20, preferably 2 to 6, carbon atoms and $R_3$ can have 1 to 10, preferably 1 to 6 carbon atoms, and the total number of carbon atoms in each of these compounds can be as great as 50 although it is preferably not greater than 20. The term polycycloalkyl covers monovalent radicals from saturated bicyclo or tricyclo-bridged hydrocarbon ring systems. Where $R_1$ and $R_2$ comprise one or more cycloalkyl radicals, such radicals preferably have 5 or 6 ring carbon atoms. Subscript x is an integer from 1 to 20, preferably 1 to 6, and subscript y is an integer from 3 to 20, preferably 3 to 6.

The preparation of these materials is described in U.S. Pat. No. 3,278,526 wherein N-mercaptoalkyl amides are prepared by a free radical catalyzed reaction of $H_2S$ with certain N-alkenyl amides. Representative of N-alkenyl amides reacted with $H_2S$ to prepare the N-mercaptoalkyl amides in this invention include:

- N-vinyl-N-methyl-formamide
- N-allylformamide
- N-ethyl-N-vinyl formamide
- N-allylacetamide
- N-(2-butenyl)propionamide
- N-(5-hexenyl)-N-ethylpropionamide
- N-(2-methylallyl)-N-n-pentylcyclohexanecarboxamide
- N-allyl-N-(3-methyl-n-butyl)-2-(3-methylcyclohexyl)cyclopropanecarboxamide
- N-eicosyl-N-vinyleicosanecarboxamide
- N-decyl-N-5-decenylcyclohexanecarboxamide
- N-vinyl-N-methyl-cyclohexylacetamide
- N-allyl-2-methylcyclohexanecarboxamide N-(5-hexenyl)-3-(alpha-pinyl)caproamide
N-vinyl-N-methyl-2-(3-methylcyclopentyl)butyramide
N-vinyl-N-cyclopropyl-cyclopropanecarboxamide
N-(8-nonenyl)-N-cyclohexyldecalincarboxamide
N-decyl-N-9-decenyl-3-undecylpelargonamide
N-(19-eicosenyl)-N-(4-n-butylcyclooctyl)3-n-propyltetradecanecarboxamide
N-vinyl-N-pinyl-cycloeicosanecarboxamide
N-allyl-N-3-cyclohexylpropylacetamide
N-2-butenyl-N-cyclopropylformamide
N-vinyl-N-cycloeicosyl-4-cyclododecylvaleramide
N-vinyl diformamide
N-allyl diacetamide
N-2-butenyl dibutyramide
N-vinyl-N-acetylheneicosanamide
N-3-octenyl diheneicosanamide
N-19-eicosenyl-N-propionyl decanoamide
N-vinyl di(cyclohexanecarboxamide)
N-3-pentenyl-N-acetylcyclohexanecarboxamide
N-vinyl-N-propionylcyclopropanecarboxamide
N-4-decenyl-N-formylcycloeicosanecarboxamide
N-allyl di(cyclohexaneacetamide)
N-vinyl-N-acetylcyclopropaneacetamide
N-allyl-N-propionylmethylcyclopropanecarboxamide
N-vinyl-N-formyl-(14-cyclohexyl)tetradecanecarboxamide
N-allyl-N-acetyl-4-tetradecylcyclohexanecarboxamide
N-vinyl di(4-[3-butylcyclohexyl])decanecarboxamide
N-allyl di(1-penanecarboxamide)
N-allylsuccinimide
N-vinyloximide
N-2-butenylglutarimide
N-allyl-3-methyladipimide
N-5-hexyl-2,3-di-n-butylsuberimide
N-19-eicosenyl-4-cyclohexylsebacimide
N-vinylmalonimide
N-allyl-2,2-dimethylmalonimide
N-4-pentenyl-3-dicyclohexylpimelimide
N-allyl-2-methylcyclopentyl-1,22-docosanedicarboximide
N-vinyl-2-([3-ethylcyclohexyl]methyl)azelaimide
N-15-hexadecenyl-4-tetradecyl-1,20-eicosanedicarboximide
N-4-octenyl-2-cyclopropylmalonimide
N-vinyl-2-cycloeicosylsuccinimide
N-allyl-3-(2-cyclohexylethyl)glutarimide
N-9-decenyl-2-cyclododecylsuccinimide
N-vinyl-2-eicosyladipimide
N-allyl-2,2,3,3,4,4-hexamethylglutarimide
N-3-butenyl-3(14-cyclohexyltetradecyl)suberimide
N-3-pentenyl-4-(2-tetradecylcyclohexyl)sebacimide
N-allyl-2-methylcyclopropylmalonimide
N-vinyl-2-cyclopropylmethylpimelimide
N-allyl-3-(1-bicyclo[2.2.0]hexyl)adipimide
N-(2-methylenepentyl)-3-(4-methylcyclohexyl)-4-ethyl-5-cyclohexyladipimide
N-vinyl-2-pyrrolidone
N-allyl-2-piperidone
N-vinylcaprolactam
N-2-butenyl-12-aminolauric acid lactam
N-(7-decenyl)-14-amino-5-cyclohexylmyristic acid lactam
N-vinyl-4-methylcyclohexylcaprolactam
N-allyl-3-cyclohexylmethyl-2-pyrrolidne
N-allyl-3-dicyclohexyl-2-piperidone
N-(19-eicosenyl)-19-amino-5-decyleicosanoic acid lactam
N-vinyl-4-cyclopropyl-21-aminoheneicosane acid lactam
N-2-butenyl-3-cycloeicosylcaprolactam
N-allyl-3-(2-tetradecylcyclohexyl)piperidone
N-vinyl-3-(12-cyclohexyltetradecyl)pyrrolidone
N-3-pentenyl-4-(methylcyclopropyl)caprolactam
N-vinyl-3-(cyclopropylmethyl)piperidone
N-allyl-3-eicosylcaprolactam
N-vinyl-3-(2-[4-methylcyclohexyl]ethyl)pyrrolidone
N-2-butenyl-3-methylcyclopropylmethylpiperidone
N-allyl-3-(12[4-ethylcyclohexyl]dodecyl)caprolactam
N-(2-methylenepentyl)-3-(3-methylcyclohexyl)-4-methyl-5-cyclohexyl-2-piperidone and the like. The preferred N-mercaptoalkyl amide for use in this invention is N-2-mercaptoethyl-2-pyrrolidone prepared from $H_2S$ and N-vinyl-2-pyrrolidone.

The amount of N-mercaptoalkyl amide employed as a depressant can be widely varied. Often, the amount is based on the amount of flotation or collecting agent employed. On this basis weight ratio of N-mercaptoalkyl amide:flotation agent can be broadly from 0.5:1 to 10:1, preferably, from 1:1 to 5:1 so that the amount of N-mercaptoalkyl amide employed falls within the range of about 0.005 to about 1 lb per ton of ore.

Flotation or collecting agents useful in this invention can be chosen from any of the known operable compounds among which are xanthates, dithiophosphates, dithiocarbamates, thiols (mercaptans), thiocarbanilide, fatty acid soaps, arenesulfonates or alkylarenesulfonates, alkyl sulfates, primary amines, quaternary ammonium salts, and alkylpyridinium salts. The preferred flotation agents are the alkali metal alkyl xanthates. Among the suitable alkali metal alkyl xanthates which may be used are the potassium salts of ethyl xanthate, isopropyl xanthate, butyl xanthate, amyl xanthate, hexyl xanthate, cetyl xanthate and the like.

The amount of flotation agent employed varies considerably depending on the type of flotation agent employed, pH, and the type of mineral being floated (etc. sulfide, oxide, etc). For sulfide mineral flotation, generally only about 0.01 to about 0.1 lbs. of xanthate is required per ton of ore.

Any copper-bearing ore is within the scope of this invention. Some copper-bearing ores are, but are not limited to, such materials as

| | |
|---|---|
| Sulfides | |
| Covallite | $CuS$ |
| Chalcocite | $Cu_2S$ |
| Chalcopyrite | $CuFeS_2$ |
| Bornite | $Cu_5FeS_4$ |
| Cubanite | $Cu_2SFe_4S_5$ |
| Valeriite | $Cu_2Fe_4S_7$ or $Cu_3Fe_4S_7$ |
| Enargite | $Cu_3(As,Sb)S_4$ |
| Tetrahydrite | $Cu_3SbS_2$ |
| Tennanite | $Cu_{12}As_4S_{13}$ |
| Oxides | |
| Cuprite | $Cu_2O$ |
| Tenorite | $CuO$ |
| Malachite | $Cu_2(OH)_2CO_3$ |
| Azurite | $Cu_3(OH)_2CO_3$ |
| Antlerite | $Cu_3SO_4(OH)_4$ |
| Brochantite | $Cu_4(OH)_6SO_4$ |
| Atacamite | $Cu_2Cl(OH)_3$ |
| Chrysocolla | $CuSiO_8$ |
| Complexes | |
| Famatinite | $Cu_3(Sb,As)S_4$ |

-continued

| | |
|---|---|
| Bournonite | $PbCuSbS_3$ |

Copper-bearing ores are generally associated with other valuable metal-containing ores which together may be separated from gangue or waste material during an initial flotation process and then each subsequently separated by an additional flotation process or processes wherein compounds of this invention are employed to depress the flotation of the copper-bearing ores. Some of these valuable non-copper metal-containing ores are, but are not limited to, such materials as:

| | | |
|---|---|---|
| Antimony-bearing ores | Stibnite | $Sb_2S_3$ |
| Zinc-bearing ores | Sphalerite | ZnS |
| | Zincite | ZnO |
| | Smithsonite | $ZnCO_3$ |
| Molybdenum-bearing ores | Molybdenite | $MoS_2$ |
| | Wulfenite | $PbMoO_4$ |
| Silver-bearing ores | Argentite | $Ag_2S$ |
| | Stephanite | $Ag_5SbS_4$ |
| | Hessite | $AgTe_2$ |
| Chromium-bearing ores | Daubreelite | $FeSCr_2S_3$ |
| | Chromite | $FeO \cdot Cr_2O_3$ |
| Gold-bearing ores | Sylvanite | $AuAgTe_2$ |
| | Calaverite | AuTe |
| Platinum-bearing ores | Cooperite | $Pt(AsS)_2$ |
| | Sperrylite | $PtAs_2$ |

and the like and mixtures thereof.

Any froth flotation apparatus can be used in this invention. The most commonly used commercial flotation machines are the Agitair (Galigher Co.), Denver Sub-A (Denver Equipment Co.), and the Fagergren (Western Machinery Co.). Smaller, laboratory scale apparatus such as the Hallimond cell can also be used.

The instant invention was demonstrated in tests conducted at ambient room temperature and atmospheric pressure. However, any temperature or pressure generally employed by those skilled in the art is within the scope of this invention.

The following examples serve to illustrate the operability of this invention. Reasonably pure copper-bearing mineral sulfides are employed without non-copper-bearing ores or gangue materials so that more accurate measurements can be made. All of the tests described were performed in a Hallimond cell using samples consisting of one gram of granulated mineral (−65+100 mesh). This cell permits continuous pH measurements and has means to control pH accurately by injection from a syringe of carefully controlled amounts of acid (HCl) or base (NaOH). The total useful volume of the cell is 170 mL with a cup volume of 70 mL.

EXAMPLE I

This example is a control which illustrates that copper-bearing mineral sulfides cannot be removed by a froth flotation process from mining deposits without the use of flotation aids. To a 70 mL capacity Hallimond cell was charged 1 gram of granulated chalcocite ($Cu_2S$) and about 69 mL of demineralized water (pH=6.5, resistivity<1 million$\Omega$) and enough 10 weight percent aqueous NaOH to maintain the pH at 9.04. The mineral was conditioned in the cup for 5 minutes while magnetic agitation was applied and maintained constant by a magnetic field, revolving at 800 rpm. A flow of nitrogen, measured by a calibrated capillary (F and P Co., Precision Bore Flowrator Tube No. 08F-1/16-08-5/36), was also maitained constant at 4 std. m 4 min. A volume of 100 mL of demineralized water, adjusted to a 9.04 pH with aqueous NaOH, was then introduced into the cell. Flotation was maintained for 10 minutes using the same value of nitrogen flow, 4, but 700 rpm agitation; the pH value remained unchanged. The floated fractions were recovered, oven dried at 82° C. (180° F.) for 24 hours and weighed. There was obtained 0.04 grams of chalcocite (4 weight percent) illustrating the inability of the mineral to be floated by itself. The mineral remaining in the Hallimond cell, referred to as "sink" or "reject", was assumed without weighing to be the balance, namely, 0.96 grams (96 weight percent). The experiment was repeated using 1 gram of chalcopyrite, $CuFeS_2$. Again there was obtained 4 weight percent floated mineral and 96 weight percent sink.

EXAMPLE II

This example is a control and illustrates that copper-bearing mineral sulfides can be removed by a froth flotation process from mining deposits with the aid of a collector or flotation agent like potassium amyl xanthate. The process described in Example I was repeated except varying amounts of potassium amyl xanthate were added along with either 1 gram of chalcocite or 1 gram of chalcopyrite. These results which are listed in Table I show that KAX is a good flotation or collecting agent for copper-bearing mineral sulfides, particularly chalcocite.

TABLE I

Effect of Potassium Amyl Xanthate (KAX) Concentration on Froth Flotation of Copper-Bearing Mineral Sulfides

| Mineral | KAX, mg/L | pH | % Floats | % Sinks |
|---|---|---|---|---|
| 1. Chalcocite | 5 | 9.00 | 96 | 4 |
| | 15 | 8.30 | 100 | 0 |
| | 30 | 8.34 | 100 | 0 |
| 2. Chalcopyrite | 5 | 9.03 | 48 | 52 |
| | 15 | 8.57 | 49[a] | 51[a] |
| | 30 | 8.60 | 78[a] | 22[a] |

[a]Average of 2 determinations

EXAMPLE III

This example is a control employing beta mercaptoethanol, BME, as a copper depressant. Mercapto alcohols are reported in U.S. Pat. No. 3,785,488 to be copper depressants. The procedure described in Example II was repeated with varying amounts of KAX except that after flotation, the cell was cleaned and 1 gram of dried xanthate-laden float was returned in the cleaned cell along with an appropriate amount of BME and the mixture stirred magnetically for 5 minutes.

The cell was then diluted with demineralized water to a total volume of 70 mL and again conditioned for 5 minutes. Then 100 mL of demineralized water was added and the mixture buffered to a pH of about 8.5 After conducting the flotation for 10 minutes the floated fractions were collected, dried, and weighed. Table II lists these results using various concentrations of the initial collector KAX and the control depressant, BME. These results show BME as a good copper depressant but not a good copper flotation agent.

TABLE II

Beta Mercaptoethanol (BME) as a Depressant for Copper-Bearing Mineral Sulfides

| Mineral | KAX, mg/L | BME, mg/L | pH | % Floats | % Sinks |
|---|---|---|---|---|---|
| 1. chalcocite | — | 30 | 8.52 | 2 | 98 |
| | 15 | 45 | 8.04 | 50 | 50 |
| | 15 | 90 | 8.01 | 4 | 96 |
| | 30 | 30 | 8.28 | 87 | 13 |
| | 30 | 90 | 8.18 | 82 | 18 |
| 2. chalcopyrite | — | 30 | 8.55 | 2 | 98 |
| | 15 | 90 | 8.91 | 47 | 53 |
| | 30 | 90 | 8.80 | 57 | 43 |

EXAMPLE IV

This example is a control illustrating that N-mercaptoalkyl amides used above are not efficient collectors for copper-bearing mineral sulfides. The process described in Example I was repeated adding 5.1 milligrams (30 mg/liter) of N-2-mercaptoethyl-2-pyrrolidone along with either 1 gram of chalcocite or 1 gram of chalcopyrite. The results, listed in Table III, show that N-2-mercaptoethyl-2-pyrrolidone is not a good collector for chalcocite or chalcopyrite.

TABLE III

N-2-Mercaptoethyl-2-Pyrrolidone (MEP) as a Collector for Copper-Bearing Mineral Sulfides

| Mineral | MEP, mg/L | pH | % Floats | % Sinks |
|---|---|---|---|---|
| 1. chalcocite | 30 | 8.33 | 6 | 94 |
| 2. chalcopyrite | 30 | 8.82 | 7 | 93 |

EXAMPLE V

This example illustrates that N-mercaptoalkyl amides, here exemplified by N-2-mercaptoethyl-2-pyrriolidone, are good depressants for copper-bearing mineral sulfides. The procedure described in Example II was repeated with varying amounts of KAX except that after the flotation, the cell was cleaned and 1 gram of dried xanthate-laden float was returned to the cleaned cell along with the appropriate amount of N-2-mercaptoethyl-2-pyrrolidone (MEP) and the mixture conditioned for 5 minutes. The cell was then diluted with demineralized water to a total volume of 70 mL and again conditioned for 5 minutes. Then 100 mL of demineralized water was added and the mixture buffered to a pH of about 8.50. After conducting the flotation for 10 minutes the floated fractions were collected, dried, and weighed. Table IV lists these results using various concentrations of KAX the initial collector, and MEP, the exemplified N-mercaptoalkylamide depressant. These results show that MEP functions as a depressant particularly at lower KAX levels.

TABLE IV

N-2-Mercaptoethyl-2-Pyrrolidone (MEP) as a Depressant for Copper-Bearing Mineral Sulfides

| Mineral | KAX, mg/L | MEP, mg/L | pH | % Floats | % Sink |
|---|---|---|---|---|---|
| 1. chalcocite | 15 | 45 | 8.28 | 21 | 79 |
| | 15 | 90 | 8.18 | 27 | 73 |
| | 30 | 30 | 8.32 | 91 | 9 |
| | 30 | 90 | 8.57 | 80 | 20 |
| 2. chalcopyrite | 15 | 90 | 8.44 | 48 | 52 |
| | 30 | 90 | 8.64 | 54 | 46 |

SUMMARY

The data illustrating this invention are summarized in Table V in which copper-bearing mineral sulfides are shown to require use of a flotation agent, as exemplified by potassium amyl xanthate, for separation from a slurry by a froth flotation process and once floated these minerals can be depressed from further flotation by the addition of N-mercaptoalkylamides, as exemplified by N-2-mercaptoethyl-2-pyrrolidone. N-Mercaptoalkylamide depressants are shown to be useful in selectively separating copper-bearing minerals from other valuable but non-copper-bearing minerals. The data show that N-2-mercaptoethyl-2-pyrrolidone is slightly better in performance with chalcocite and about equal in performance with chalcopyrite when compared at equal concentrations with beta mercaptoethanol, a representative compound within a class of materials known to be copper depressants.

TABLE V

Summary

| Example No. | Mineral | KAX[a], mg/L | BME[b], mg/L | MEP[c], mg/L | % Floats | % Sinks |
|---|---|---|---|---|---|---|
| I | chalcocite, $Cu_2S$ | — | — | — | 4 | 96 |
| II | chalcocite, $Cu_2S$ | 15 | — | — | 100 | — |
| | | 30 | — | — | 100 | — |
| III | chalcocite, $Cu_2S$ | — | 30 | — | 2 | 98 |
| | | 30 | 30 | — | 87 | 13 |
| | | 15 | 45 | — | 50 | 50 |
| IV | chalcocite, $Cu_2S$ | — | — | 30 | 6 | 94 |
| V | chalcocite, $Cu_2S$ | 30 | — | 30 | 91 | 9 |
| | | 15 | — | 45 | 21 | 79 |
| I | chalcopyrite, $CuFeS_2$ | — | — | — | 4 | 96 |
| II | chalcopyrite, $CuFeS_2$ | 15 | — | — | 49 | 51 |
| | | 30 | — | — | 78 | 22 |
| III | chalcopyrite, $CuFeS_2$ | — | 30 | — | 2 | 98 |
| | | 30 | 90 | — | 57 | 43 |
| | | 15 | 90 | — | 47 | 53 |
| IV | chalcopyrite, $CuFeS_2$ | — | — | 30 | 7 | 93 |
| V | chalcopyrite, $CuFeS_2$ | 30 | — | 90 | 54 | 46 |
| | | 15 | — | 90 | 48 | 52 |

[a]Potassium amyl xanthate
[b]Beta mercaptoethanol
[c]N-2-Mercaptoethyl-2-pyrrolidone

We claim:

1. A process for recovering copper-bearing mineral sulfides from a metallurgical concentrate, said process comprising in a froth flotation process admixing (1) froth floated metallurgical concentrate containing copper-bearing sulfides with (2) an amount of N-mercaptoalkyl amide sufficient to depress the flotation of said copper-bearing mineral sulfide and recovering the non-floated copper-bearing mineral sulfides.

2. A process of claim 1 in which the amount of N-mercaptoalkyl amide employed is within the range of about 0.005 to about 1 lb/ton of metallurgical concentrate.

3. A method of claim 1 wherein said N-mercaptoalkyl amides are chosen from materials represented by the formulas

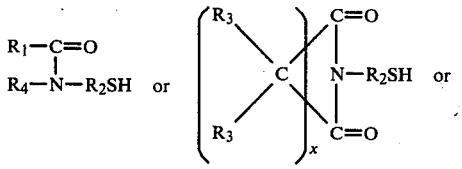

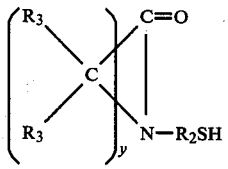

wherein $R_1$ and $R_3$ are selected from the group consisting of hydrogen, alkyl, cycloalkyl, and combinations of these radicals; $R_2$ is an alkylene radical; and $R_4$ is selected from the group consisting of $R_1$ and the radical

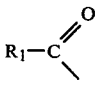

$R_1$ has 1–20 carbon atoms, $R_2$ has 2–20 carbon atoms, and $R_3$ has 1–10 carbon atoms, x is an integer from 1–20, and y is an integer from 3–20.

4. A process of claim 3 wherein said N-mercaptoalkyl amide is N-2-mercaptoethyl-2-pyrrolidone.

5. A process for recovering copper-bearing mineral sulfides from a metallurgical concentrate comprising (a) obtaining a metallurgical concentrate containing copper-bearing mineral sulfides by froth flotation of a copper-bearing mineral sulfide ore using a flotation agent suitable for selectively floating copper-bearing mineral sulfides, (b) recovering the froth floated metallurgical concentrate containing copper-bearing mineral sulfides, (c) refloating the metal concentrate of (b) with admixing of N-mercaptoalkyl amide sufficient to depress the flotation of said copper-bearing mineral sulfides, and (d) recovering the non-floating copper-bearing mineral sulfides.

6. A process of claim 5 wherein said flotation agent is an alkali metal alkyl xanthate and the N-mercaptoalkyl amide is N-2-mercaptoethyl-2-pyrrolidone.

* * * * *